US007367383B2

(12) United States Patent
Li

(10) Patent No.: US 7,367,383 B2
(45) Date of Patent: May 6, 2008

(54) MULTI-LAYER WICK STRUCTURE OF HEAT PIPE

(76) Inventor: Jia-Hao Li, 6F., No.686, Jhongjheng Rd., Sindian City, Taipei County 231 (TW)

( * ) Notice: Subject to any disclaimer, the term of this patent is extended or adjusted under 35 U.S.C. 154(b) by 347 days.

(21) Appl. No.: 11/207,737

(22) Filed: Aug. 22, 2005

(65) Prior Publication Data

US 2007/0240853 A1 Oct. 18, 2007

(30) Foreign Application Priority Data

Oct. 27, 2004 (TW) ..... 93217088 U

(51) Int. Cl.
*F28D 15/00* (2006.01)

(52) U.S. Cl. ..... 165/104.26; 165/104.33

(58) Field of Classification Search ..... 165/104.26
See application file for complete search history.

(56) References Cited

U.S. PATENT DOCUMENTS 3,680,189 A * 8/1972 Noren ..... 29/890.032
3,822,743 A * 7/1974 Waters ..... 165/104.26
3,964,902 A * 6/1976 Fletcher et al. ..... 29/890.032
4,186,796 A * 2/1980 Usui ..... 165/104.26
4,674,565 A * 6/1987 Beam ..... 165/104.26
2004/0112450 A1* 6/2004 Hsu ..... 138/38

FOREIGN PATENT DOCUMENTS

JP 57108592 A * 7/1982
JP 2000074581 A * 3/2000
JP 2001183080 A * 7/2001

* cited by examiner

*Primary Examiner*—Allen J. Flanigan

(57) ABSTRACT

A multi-layer wick structure of the heat pipe, comprising a hollow heat pipe body and a weave mesh of the wick structure provided on the internal surface of the heat pipe body, wherein the weave mesh of the wick structure is subjected to at least one folding such that the periphery thereof is curled into a circle. By folding the weave mesh of the wick structure, it can be formed into a multi-layer structure. Then, after inserting the multi-layer wick structure and by the shrinking process of the heat pipe body, the wick structure can be tightly attached to the internal surface of the heat pipe body, thereby to increase the capillary force of the heat pipe and the amount of liquid to be delivered.

4 Claims, 6 Drawing Sheets

MULTI-LAYER WICK STRUCTURE OF HEAT PIPE

BACKGROUND OF THE INVENTION

1. Field of the Invention

The present invention relates to a multi-layer wick structure of a heat pipe, and more particularly, to a wick structure of a heat pipe having multiple wick layers.

2. Description of Related Art

The heat pipe has been applied in various types of electronics products for delivering large amount of heat without consuming significant power because of the characteristics of high thermal transmission capacity, high thermal transmission speed, high thermal conduction efficiency, light weight, none mobile element, simple structure and versatile applications. The conventional heat pipe includes a wick structure attached to an interior surface of a heat-pipe body. The wick structure includes a weaving mesh that has capillary effect, such that a working fluid filled in the heat pipe can be delivered by using the capillary effect of the wick structure. Further, in order to improve the capillary force, the wick structure has been formed into multiple layers, thereby to increase the amount of the working fluid to be delivered.

As shown in FIG. 1, the weaving mesh of a wick structure 1*a* in a conventional heat pipe is curled into a multi-layer structure. When the curled wick structure 1*a* is inserted into the heat pipe body 2*a*, a sintering process is required to attach the curled wick structure 1*a* to the internal surface of the heat pipe body 2*a*. However, during the sintering process, since the weaving mesh of the wick structure 1*a* is too soft, and the tightness between the superimposed portion A of the wick structure 1*a* and the internal surface is insufficient, the wick structure 1*a* will be softened and collapsed during the high-temperature annealing process, such that the wick structure 1*a* cannot be completely attached to the internal surface of the heat pipe body 2*a*.

SUMMARY OF THE INVENTION

The present invention is to provide a multi-layer wick structure of the heat pipe. A weave mesh of the wick structure is subjected to at least one folding in accordance with the actual demands, such that the weave mesh of the wick structure can be formed into a multi-layer structure. By the shrinking process of the heat pipe body, the weave mesh of the wick structure between layers can be tightly attached to the internal surface of the heat pipe body, thereby to increase the capillary force of the heat pipe and the amount of liquid to be delivered.

In order to achieve the above object, the present invention provides a multi-layer wick structure of the heat pipe comprising a hollow heat pipe body and a weave mesh of the wick structure provided on the internal surface of the heat pipe body, wherein the weave mesh of the wick structure is subjected to at least one folding such that the periphery thereof is curled into a circle. By folding the weave mesh of the wick structure to form a multi-layer structure, inserting the multi-layer wick structure into the heat pipe body, and shrinking the heat pipe body, the wick structure can be tightly attached to the internal surface of the heat pipe body.

The above summaries are intended to illustrate exemplary embodiments of the invention, which will be best understood in conjunction with the detailed description to follow, and are not intended to limit the scope of the appended claims.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

In order to make the Examiner further understand the characteristics and technical contents of the present invention, the following detailed description is made in conjunction with the accompanying drawings which are used for illustration but not for limitation to the present invention.

With reference to FIGS. 2 to 6, the present invention provides a multi-layer wick structure of a heat pipe. By the shrinking process of the heat pipe body 2*a*, the weave mesh of the wick structure 1 between layers can be tightly attached to the internal surface of the heat pipe body 2.

Figure 1:
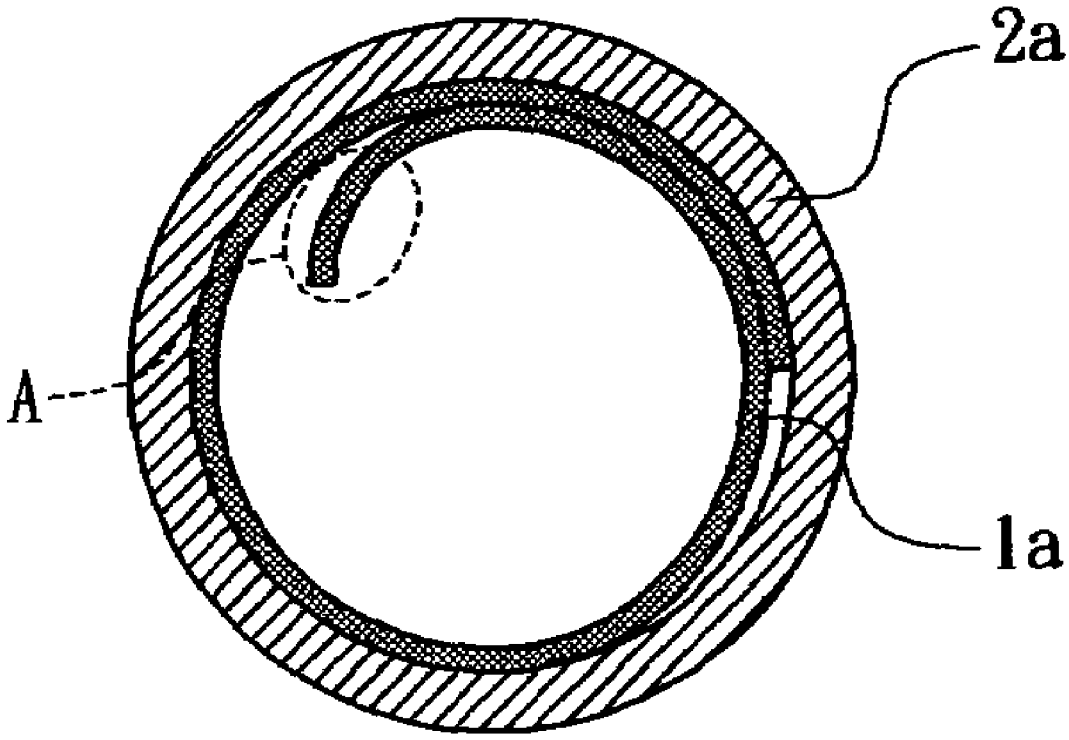
FIG. 1 PRIOR ART
FIG. 1 is a cross sectional view of a conventional heat pipe product.
Figure 2:
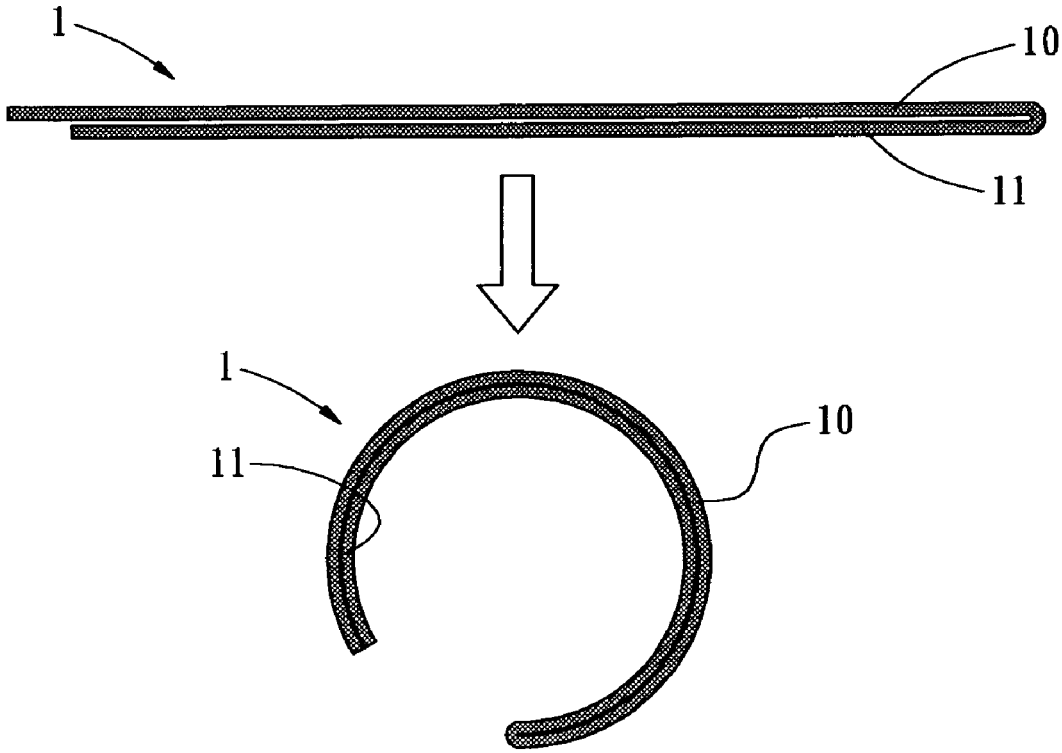
FIG. 2 is a schematic view showing the action of curling the multi-layer wick structure in accordance with the present invention.
Figure 3:
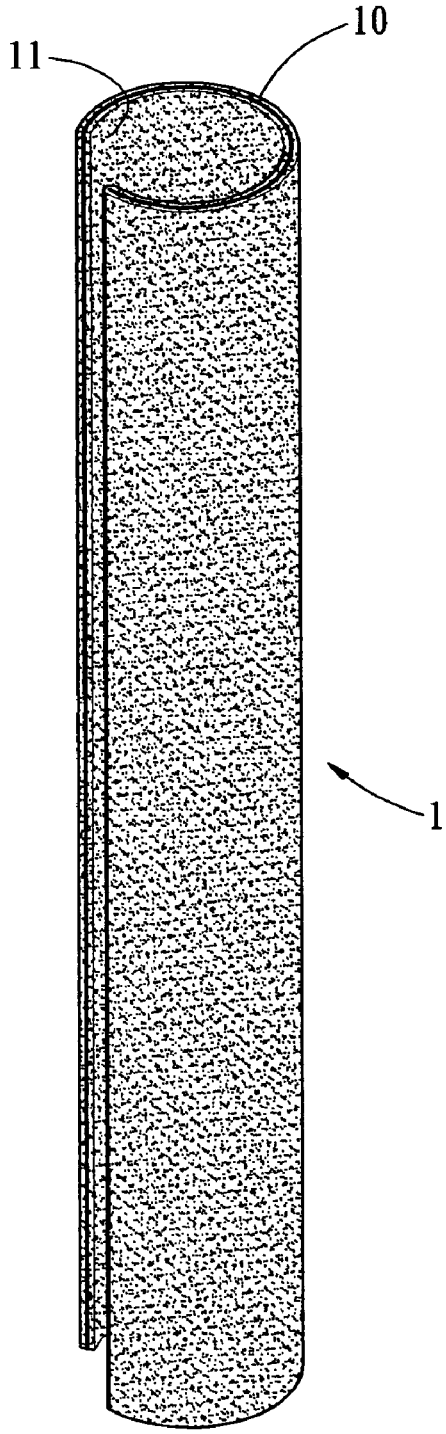
FIG. 3 is a perspective view showing that the multi-layer wick structure is curled into an open circle.

As shown in FIGS. 2 and 3, first, a weave mesh of the wick structure 1 is prepared, and then, the weave mesh of the wick structure is subjected to at least one folding in accordance with the actual demands, such that a multi-layer wick structure is formed. In the embodiment of the present invention, the weave mesh wick structure 1 is subjected to one folding to form a first wick layer 10 and a second wick layer 11. The first wick layer 10 is intended to be provided on the outmost layer, and its width is larger than that of the second wick layer 11 to be provided on the inner layer. Then, by curling the first and second wick layers 10, 11, the peripheral length of the first wick layer 10 will be larger than that of the second wick layer 11. Thus, the structure as shown in FIG. 3 is formed.

Figure 4:
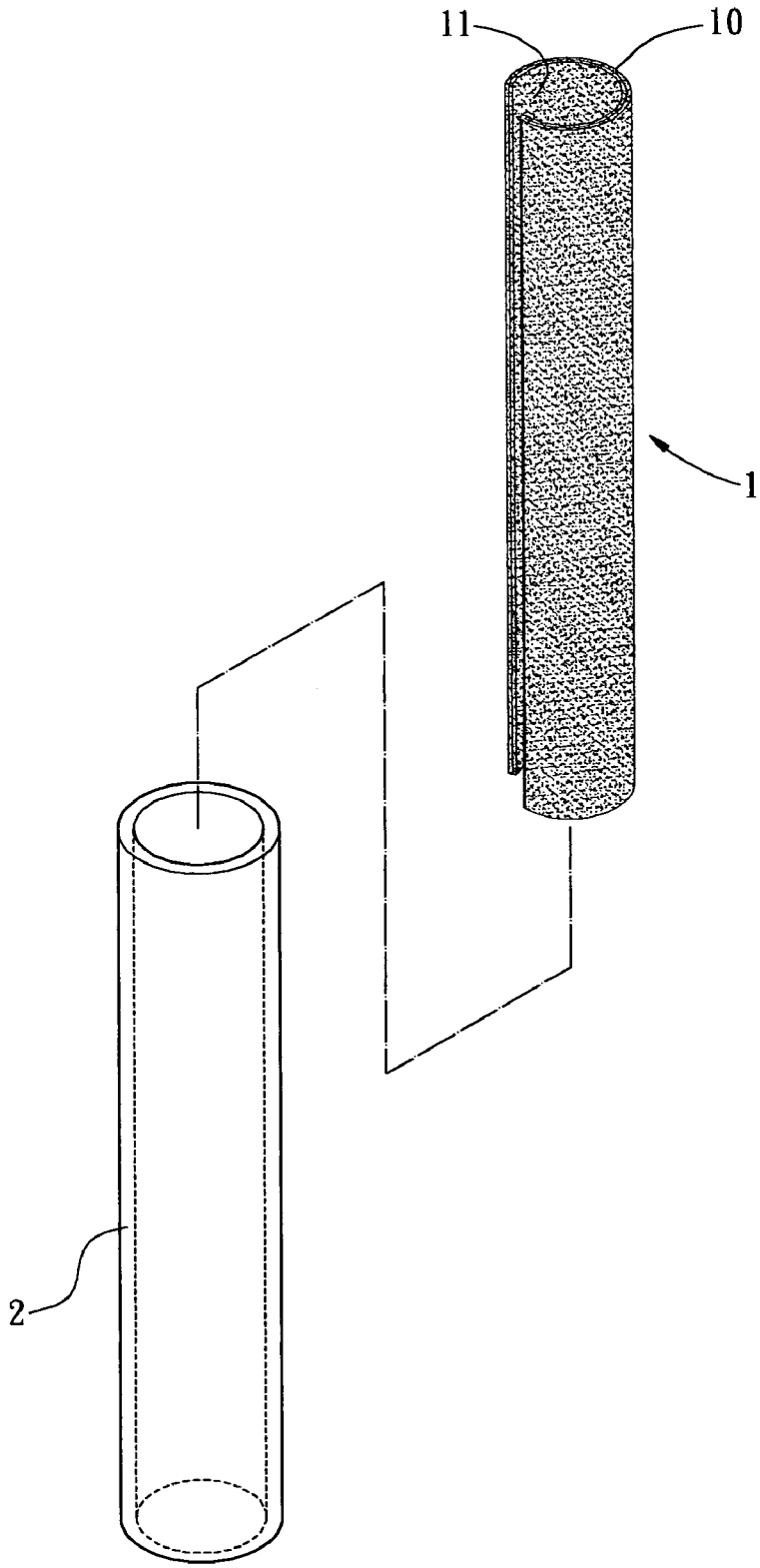
FIG. 4 is a schematic view showing the action of inserting the multi-layer wick structure into the heat pipe body.
Figure 5:
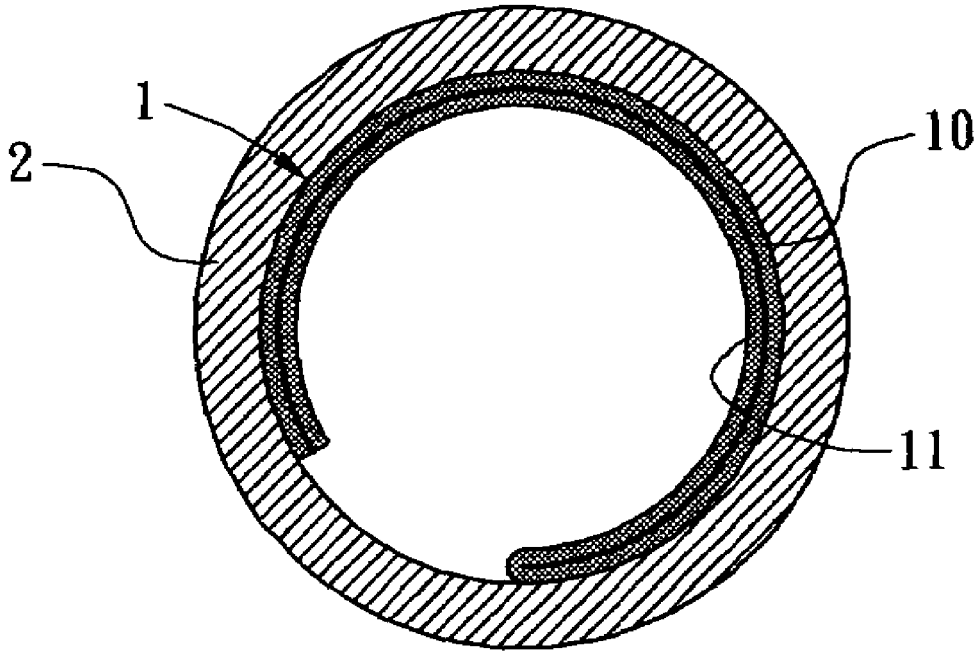
FIG. 5 is a cross sectional view showing a heat pipe body not being subjected to the shrinking process.

With reference to FIGS. 4 and 5, another heat pipe body 2 is prepared. Further, the diameter of the heat pipe body 2 is larger than that to be formed. Therefore, when the above wick structure 1 is inserted into the heat pipe body 2, the first and second wick layer 10, 11 can be curled into an open circle in the heat pipe body 2, as shown in FIG. 5.

Figure 6:
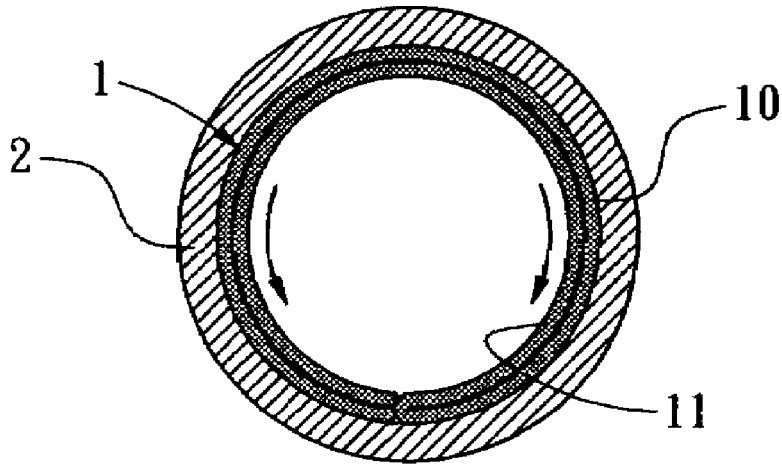
FIG. 6 is a cross sectional view of the heat pipe product in accordance with the present invention.

As shown in FIG. 6, finally, by shrinking the heat pipe body 2 to the intended diameter, the first and second wick layer 10, 11 provided therein will also be compressed by the shrinking process to be curled into a circle. As a result, the wick structure 1 between layers can be tightly attached to the internal surface of the heat pipe body 2 without being easily collapsed during the high-temperature annealing process, thereby to keep a sufficient heat conductivity of the heat pipe.

Further, since the first and second wick layers 10, 11 are formed into weave meshes woven by warps extending in the axial direction of the heat pipe body 2 and woofs surrounding in the radial direction of the heat pipe body 2. The warps and woofs of the first and second wick layer 10, 11 can be made by two materials having different melting points. For example, the warps can be made by phosphor bronze, and the woofs can be made by oxygen-free copper. As a result, during the sintering process, the material having a lower melting point will reach the sintering temperature and be sintered faster than the other material having a higher melting temperature. Thus, during the sintering process, the material having a higher melting temperature is used for supporting the material having a lower temperature.

Accordingly, by using the above structure, the multi-layer wick structure of the present invention can be achieved.

Figure 7:
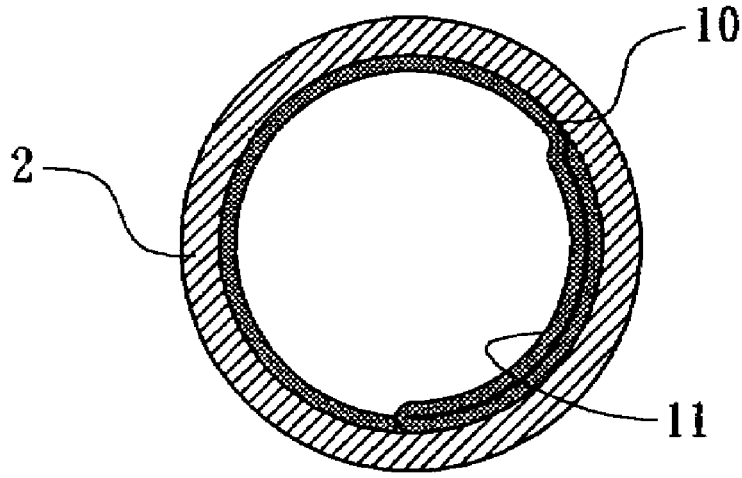
FIG. 7 is a cross sectional view showing a further embodiment of the heat pipe product in accordance with the present invention.

Further, FIG. 7 is a cross sectional view showing another embodiment of the heat pipe product of the present invention. The first wick layer 10 provided on the outmost layer can be partially formed on one side of the internal surface of the heat pipe body 2, and cooperates with the second wick layer 11 provided on the inner layer to form a curl having a closed circle. Therefore, a wick structure having a partially thickened layer is attained to increase the capillary force in a portion of the heat pipe and the amount of liquid to be delivered.

Thus, with the method for forming the multi-layer wick structure of the present invention and the product thereof, since the multi-layer wick structure 1 does not need to be curled into a closed circle before being inserted into the heat pipe body 2, the insertion is thus easier. By the shrinking process and thus the shrinking force of the heat pipe body 2, the first and second wick layer 10, 11 can be tightly attached to the internal surface of the heat pipe body 2 so as to provide sufficient support to the wick structure 1.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A heat pipe, comprising:

a hollow heat pipe body; and a weave mesh wick subjected to at least one folding and curled to attach on the internal surface of the heat pipe body, wherein the wick structure is folded once to form a first wick layer and a second wick layer, and wherein the first wick layer provided on the outmost layer is partially formed on one side of the heat pipe body.

2. The heat pipe according to claim 1, wherein the first wick layer is provided on the outmost layer, and a peripheral length of the first wick layer is larger than that of the second wick layer provided on the inner layer.

3. The heat pipe according to claim 1, wherein the first and second wick layer are woven by warps extending in the axial direction of the heat pipe body and woofs surrounding in the radial direction of the heat pipe body, and the warps and the woofs of the first and second wick layers are made by two materials having different melting points.

4. The heat pipe according to claim 3, wherein the warps are made by phosphor bronze, and the woofs are made by oxygen-free copper.

* * * * *